United States Patent [19]

Cheng

[11] 4,393,798

[45] Jul. 19, 1983

[54] ROTARY SHUTTLE FOR A SEWING MACHINE

[76] Inventor: Haw-Lin Cheng, No. 119, Chung Shan Rd., Taiwan, Taiwan

[21] Appl. No.: 191,537

[22] Filed: Sep. 29, 1980

[51] Int. Cl.[3] ..... D05B 57/16; D05B 71/02

[52] U.S. Cl. ..... 112/231; 112/256

[58] Field of Search ..... 112/228, 229, 230, 231, 112/232, 256

[56] References Cited

U.S. PATENT DOCUMENTS

| | | | |
|---|---|---|---|
| 1,169,909 | 2/1916 | Ashworth | 112/38 |
| 1,179,371 | 4/1916 | Diehl et al. | 112/232 |
| 1,691,242 | 11/1928 | Greenword | 112/231 X |
| 2,344,110 | 3/1944 | Rubel | 112/228 |
| 2,415,484 | 2/1947 | Haas | 112/228 X |
| 2,857,869 | 10/1958 | Odermann | 112/228 |
| 3,146,744 | 9/1964 | Bradshaw | 112/232 |
| 4,284,019 | 8/1981 | Marchesi | 112/256 |

FOREIGN PATENT DOCUMENTS

| | | | |
|---|---|---|---|
| 728247 | 4/1955 | United Kingdom | 112/231 |

*Primary Examiner*—Wm. Carter Reynolds
*Attorney, Agent, or Firm*—Tak Ki Sung

[57] ABSTRACT

An internal housing comprises an upper part 1, a lower part 3 and a middle part 2. The middle part 2 connects the internal housing to an external housing 4 to form a rotary loop taker. The external housing 4 comprises an elastic piece 6 for engaging thread as well as a tail base 42 and an internally tapered ring 5 for fitting the loop taker into a sewing machine. The middle part 2 provides a ring about which the external housing 4 is rotatable, and to facilitate this rotation, this middle part is of or coated with Teflon.

2 Claims, 13 Drawing Figures

ROTARY SHUTTLE FOR A SEWING MACHINE

This invention relates to an improved rotary loop taker for a sewing machine. A loop taker conventionally does not pass through a needle loop while passing a thread loop over a supply of thread on a bobbin.

Traditionally, rotary loop taker shuttles for sewing machines comprise an external housing which is made of metal and elastic pieces which are joined together with screws. The screws frequently become loose while the shuttle is rotating. This is not only troublesome but also decreases the working efficiency of the loop taker. The parts must frequently be lubricated with oil which can lead to contamination of the various working parts of the loop taker. Any oil orifices, provided to facilitate lubrication, are easily blocked, which can result in unnecessary wear of the shuttle which can affect its rotation. Furthermore, the use of screws can make the loop taker unbalanced which in turn makes it difficult to rotate at high speed.

An object of the invention is to resolve the abovementioned defects or disadvantages of known rotary loop taker.

With this object in view the present invention provides a rotary loop taker for a sewing machine comprising internal and external housings connected together by means of a ring made of or coated with Teflon, so as to be rotatable relative to one another, and an elastic piece, for engaging thread, secured to the external housing.

Because Teflon has a low coefficient of friction, particularly when it rubs with metal, it will not produce loud noise, and is not susceptible to wear. It is very durable and it does not need the addition of oil as a lubricant, thus assuring cleanliness of the various working parts of the loop taker. Another advantage of the invention is that there need not be any holes for screws on the external housing, and its rotation is, therefore, not affected by such screw holes. Its rotary speed can be doubled compared to known loop taker shuttles having screw holes, and since there are no screws it remains balanced at all times.

The invention will be described further, by way of example, with reference to the accompanying drawings, in which.

Figure 1:
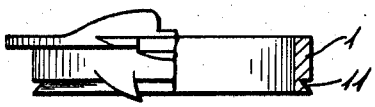
FIG. 1 is a part sectional front view of an upper part of an internal housing which forms part of a preferred embodiment of the rotary loop taker of the invention.
Figure 2:
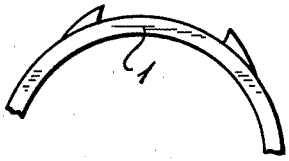
FIG. 2 is a detached fragmentary underneath view corresponding to FIG. 1.
Figure 3:
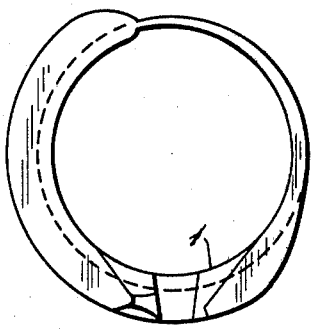
FIG. 3 is a plan view corresponding to FIGS. 1 and 2.
Figure 6:
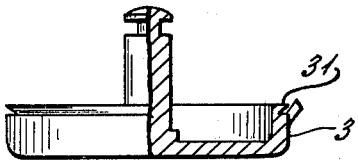
FIG. 6 is a view similar to FIGS. 1 and 4, but illustrating a lower part of the internal housing.
Figure 4:
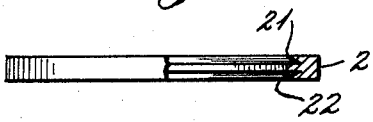
FIG. 4 is a view similar to FIG. 1, but illustrating a middle part of the internal housing.
Figure 7:
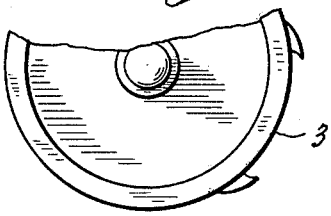
FIG. 7 is a fragmentary plan view corresponding to FIG. 6.
Figure 5:
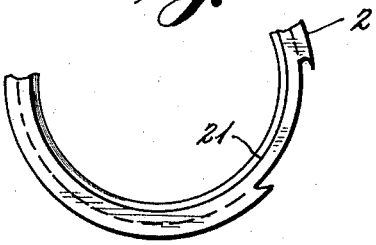
FIG. 5 is a fragmentary plan view corresponding to FIG. 4.
Figure 8:
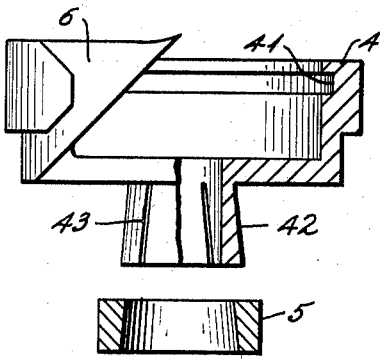
FIG. 8 is a view comparable with FIGS. 1, 4 and 6, but showing an external housing which forms another part of the preferred embodiment of the rotary loop taker of the invention.
Figure 9:
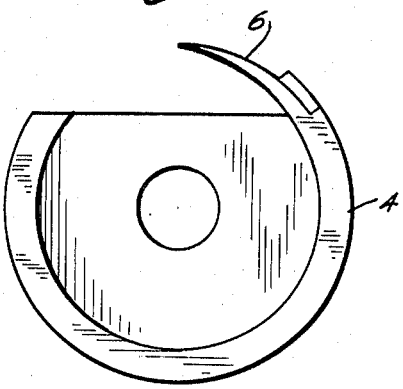
FIG. 9 is a plan view corresponding to FIG. 8.
Figure 10:
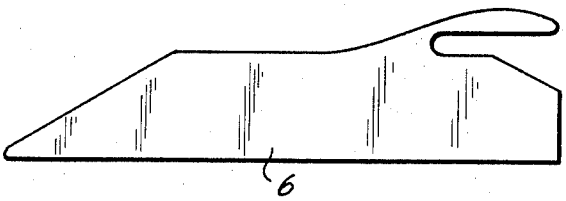
FIG. 10 is a front elevation of an elastic piece forming part of the preferred embodiment of the rotary loop taker of the invention.
Figure 11:
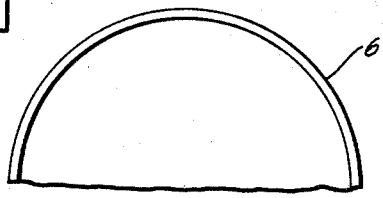
FIG. 11 is a view of the elastic piece of FIG. 10 in its use configuration.
Figure 12:
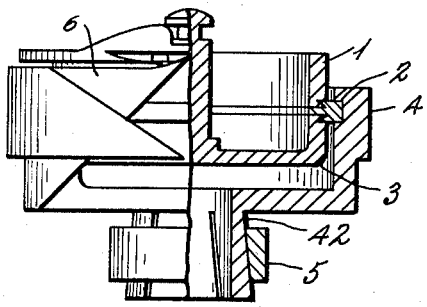
FIG. 12 is a view comparable with FIGS. 1, 4, 6 and 8 but showing the internal and external housings in their assembled condition to form the preferred embodiment of the rotary loop taker.
Figure 13:
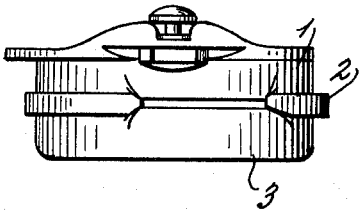
FIG. 13 is a front elevation of the internal of the assembly of FIG. 12.

Referring to the drawings, a preferred embodiment of the rotary loop taker of the invention comprises an internal housing is and an external housing 4. The internal housing composed of an upper part 1, a ring or middle part 2 and a lower part 3. On its bottom, an outside wall of the upper part 1 has oblique groove 11. The middle part 2 is a ring of or coated with Teflon and is formed with oblique lips 21 and 22 at the top and bottom edges of its inner wall. The lower part 3 has oblique groove 31 at the top of its outside wall.

When assembling the parts of the internal housing, the upper part 1 is pressed onto the oblique lip 21 of the middle part 2 so that the groove 11 thereof receives the lip 21. Similarly the lower part 3 is pressed onto the oblique lip 22 of the middle part 2 so that its groove 31 receives the lip 22. Thus the grooves 11, 31 and lips 21, 22 hold the parts firmly together.

In the inner wall of the external housing 4, there is a concave groove 41 for receiving the middle part 2. For assembling the internal housing to the external housing 4 to form the complete loop taker, the middle part 2 is inserted into the concave groove 41.

When the external housing 4 rotates relative to the internal housing it rotates about the middle part 2. Since the middle part 2 is of or coated with Teflon, and therefore has a very low coefficient of friction, it can withstand high temperatures. Furthermore, it does not need lubrication, is noiseless and it enables the external housing to revolve at high speed.

On a fixed externally frusto-conical tail base 42 of the external housing 4, there are three grooves 43, separated from each other by 120°. The tail base 42 carries an internally tapered member 5. The outside wall of the external housing 4 has secured thereto, for example, by high frequency welding, a flexible metal piece 6 for engaging thread (not shown). This enables the external housing 4 and the flexible piece 6 to be free of screw holes.

For attaching the rotary shuttle of the invention to an industrial or domestic sewing machine (not shown), the tail base 42 is set on the sewing machine's usual rotary axle system, and is fixed to the machine by means of the tapered member 5. When the external housing 4 rotates the acute tip of the flexible piece 6 hooks the thread, so that stitching can be effected.

I claim:

1. A rotary loop taker for a sewing machine comprising:

(a) an internal housing comprising an upper part and a lower part held together by a ring which forms a middle part of the internal housing;

(b) an external housing comprising a tail base over which can be fitted an internally tapered member for fitting the loop taker into a sewing machine; and (c) a flexible piece fixed to the external housing, the external housing and flexible piece being free of screw holes and the ring having a Teflon coating so that the internal and external housings are rotatable relative to each other.

2. The loop taker of claim 1 wherein the upper and lower parts of the internal housing are provided with oblique grooves for engagement therein with mating oblique lips provided in the ring.

* * * * *